United States Patent [19]

Jennings, Jr. et al.

[11] Patent Number: 5,036,918

[45] Date of Patent: Aug. 6, 1991

[54] METHOD FOR IMPROVING SUSTAINED SOLIDS-FREE PRODUCTION FROM HEAVY OIL RESERVOIRS

[75] Inventors: Alfred R. Jennings, Jr., Plano; Roger C. Smith, Dallas, both of Tex.

[73] Assignee: Mobil Oil Corporation, Fairfax, Va.

[21] Appl. No.: 446,834

[22] Filed: Dec. 6, 1989

[51] Int. Cl.[5] ..... E21B 43/24; E21B 43/267

[52] U.S. Cl. ..... 166/263; 166/271; 166/272; 166/280; 166/297; 166/308

[58] Field of Search ..... 166/280, 281, 283, 303, 166/308, 271, 272, 274, 275, 263, 297

[56] References Cited

U.S. PATENT DOCUMENTS

| | | | |
|---|---|---|---|
| 3,259,186 | 7/1966 | Dietz | 166/11 |
| 3,280,909 | 10/1966 | Closmann et al. | 166/2 |
| 3,354,954 | 11/1967 | Buxton | 166/11 |
| 3,367,419 | 2/1968 | Van Lookeren | 166/11 |
| 3,882,941 | 5/1975 | Pelosky | 166/303 |
| 3,908,762 | 9/1975 | Redford | 166/271 X |
| 4,049,525 | 9/1977 | Dutton et al. | 204/195 |
| 4,067,389 | 1/1978 | Savins | 166/246 |
| 4,109,722 | 8/1978 | Widmyer et al. | 166/306 X |
| 4,109,723 | 8/1978 | Widmyer et al. | 166/303 |
| 4,249,604 | 2/1981 | Frazier | 166/272 X |
| 4,378,849 | 4/1983 | Wilks | 166/369 |
| 4,549,608 | 10/1985 | Stowe et al. | 166/280 |
| 4,623,021 | 11/1986 | Stowe | 166/280 X |
| 4,733,726 | 3/1988 | Alameddine et al. | 166/263 |
| 4,848,468 | 7/1989 | Hazlett | 166/308 X |

*Primary Examiner*—George A. Suchfield
*Attorney, Agent, or Firm*—Alexander J. McKillop; Charles J. Speciale; Charles A. Malone

[57] ABSTRACT

A method for controlling formation fines when producing viscous oil from a consolidated or loosely consolidated formation having at least two wells therein. Both wells are perforated and hydraulically fractured at a lower level via a viscous gel fluid having a size and temperature resistant proppant therein. The proppant is of a size sufficient to filter formation fines from the oil. Cyclic steam-flooding and oil production are continued in one well, while the other well is shut-in. Prior to steam break through, the lower perforated intervals are isolated with production packers containing knock-out plugs. A correlatable selected upper interval in both wells is perforated and hydraulic fracturing is repeated. Cyclic steam-flooding and oil production are continued in the upper interval until steam break through occurs. Cyclic steam-flooding is ceased and production strings are directed through the knock-out plugs into the lower interval. Thereafter, steam is directed down the annulus from a first well into a second well in the upper interval, while producing oil from the lower interval. Thereafter, steam is circulated down both wells into the upper formation causing the formation of a "heat chest" and the production of hydrocarbonaceous fluids from the lower interval via the production string.

4 Claims, 2 Drawing Sheets

METHOD FOR IMPROVING SUSTAINED SOLIDS-FREE PRODUCTION FROM HEAVY OIL RESERVOIRS

FIELD OF THE INVENTION

This invention relates to a process for extracting hydrocarbons from the earth. More particularly, this invention relates to a method for recovering especially solids-free hydrocarbons e.g., bitumen from a subterranean formation using at least two wells.

BACKGROUND OF THE INVENTION

In many areas of the world, there are large deposits of viscous petroleum, such as the Athabasca and Peace River regions in Canada, the Jobo region in Venezuela and the Edna and Sisquoc regions in Calif. These deposits are generally called tar sand deposits due to the high viscosity of the hydrocarbons which they contain and may extend for many miles and occur in varying thickness of up to more than 300 feet. Although tar sands may lie at or near the earth's surface, generally they are located under substantial overburden which may be as great as several thousand feet thick. Tar sands located at these depths constitute some of the world's largest presently known petroleum deposits.

Tar sands contain a viscous hydrocarbon material, commonly referred to as bitumen, in an amount which ranges from about 5 to about 20 percent by weight. Bitumen is usually immobile at typical reservoir temperatures. For example, at reservoir temperatures of about 48° F., bitumen is immobile, having a viscosity frequently exceeding several thousand poises. At higher temperatures, such as temperatures exceeding 200° F., bitumen generally becomes mobile with a viscosity of less than 345 centipoises.

Since most tar sand deposits are too deep to be mined economically, a serious need exists for an in situ recovery process wherein the bitumen is separated from the sand in the formation and recovered through production means e.g. a well drilled into the deposit.

In situ recovery processes known in the art include emulsification drive processes, thermal techniques (such as fire flooding), in situ combustion, steam flooding and combinations of these processes.

Any in situ recovery process must accomplish two functions. First, the viscosity of the bitumen must be reduced to a sufficiently low level to fluidize the bitumen under the prevailing conditions. Secondly, sufficient driving energy must be applied to treated bitumen thereby inducing it to move through the formation to a well or other means for transporting it to the earth's surface.

As previously noted, among the various methods that have been proposed for recovering bitumen in tar sand deposits are heating techniques. Because steam is generally the most economical and efficient thermal energy agent, it is clearly the most widely employed.

Several steam injection processes have been suggested for heating the bitumen. One method involves a steam stimulation technique, commonly called the "huff and puff" process. In such a process, steam is injected into a well for a certain period of time. The well is then shut in to permit the steam to heat the oil. Subsequently, formation fluids, including bitumen, water and steam, are produced from the well along with sand. Production is later terminated and steam injection is preferably resumed for a further period. Steam injection and production are alternated for as many cycles as desired. A principle drawback to the "huff and puff" technique is that it does not heat the bulk of the oil in the reservoir and consequently reduces the oil recovery.

Another problem with steam drive is that the driving force of the steam flooding technique is ultimately lost when breakthrough occurs at the production well. Steam breakthrough occurs when the steam front advances to a production well and steam pressure is largely dissipated through the production well. Fluid breakthrough causes a loss of steam driving pressure characterized by a marked diminution in the efficiency of the process. After steam breakthrough the usual practice, as suggested in U.S. Pat. No. 3,367,419 (Lookeren) and U.S. Pat. No. 3,354,954 (Buxton), is to produce without steam drive until further steam injection is necessitated or production terminated. These patents are incorporated herein by reference.

U.S. Pat. No. 3,259,186 (Dietz), for example, appears to have an early teaching for conventional "huff and puff". The patent discloses a method for recovering viscous oil from subterranean formations by simultaneously injecting steam into an injection well to heat the formation. Formation fluids are then produced from the injection well. After several cycles, steam drive can be established if several adjacent injection wells have been used by injecting steam into one injection well while using another for production. U.S. Pat. No. 3,280,909 (Closmann et al.) discloses a conventional steam drive comprising steam injection to produce interconnecting fractures, but insufficient to produce oil, followed by steam drive at conventional pressures and rates. Thus, the heating and driving phases are entirely distinct. These patents are incorporated herein by reference.

Steam also releases unconsolidated formation sand grains as it lowers the viscosity of the formation oil. Formation oil, thus released, will be free to move with the oil of reduced viscosity as the formation is produced.

Therefore, what is needed is an efficient method to produce the formation, control formation fines, and still allow steam contact with oil in place in the formation.

SUMMARY OF THE INVENTION

This invention is directed to a method for producing viscous substantially solids-free hydrocarbonaceous fluids from an unconsolidated formation or reservoir. Initially, at least two spaced part first and second wells are drilled into a lower producive interval of the formation. Afterwards, these wells are hydraulically fractured with a fracturing fluid containing a proppant so as to create and prop fractures in the formation. The proppant utilized is of a size sufficient to restrict formation fines movement into the fracture. Thereafter, a predetermined volume of steam is injected into the first well in an amount sufficient to soften the viscous fluid and reduce the viscosity of said fluid adjacent to a fracture face. The first well is then produced at a rate sufficient to allow formation fines to build up on the propped fracture face communicating with said first well, thereby, resulting in a filter which is sufficient to substantially remove formation fines from the viscous hydrocarboneous fluid.

Once a desired amount of viscous fluid has been produced from the first well, it is shut in and a pre-determined amount of steam is injected into the second well. Steam injection into the second well is then ceased and hydrocarbonaceous fluids are produced from the second well at a rate sufficient to allow formation fines to build up on a fracture face communicating with said second well. The build up of formation fines on the fracture face results in a filter screen sufficient to remove formation fines from the hydrocarbonaceous fluids which are produced to the surface.

Subsequently, a second volume of steam is injected into the second well and substantially solids-free hydrocarbonaceous fluids are produced from the first well. Thereafter, the second well is shut in and a pre-determined volume of steam is injected into the first well. Afterwards, the second well is opened and oil of reduced viscosity which is substantially solids-free is produced to the surface. This cycle of injecting steam into one well, shutting in the well, and producing hydrocarbonaceous fluids from another well is repeated until a desired amount of hydrocarbonaceous fluids have been produced from the formation's lower interval.

Afterwards, both wells are shut in and the lower interval is isolated via production packers. An upper interval is then hydraulically fractured, the fracture propped, and cyclic oscillatory steam injection/production is repeated as was done on the lower interval until steam breaks through into the second well. After steam breakthrough the lower interval is re-entered and steam is circulated into the first upper interval well to the second upper interval well while producing thinned hydrocarbonaceous fluids from the lower interval.

It is therefore an object of this invention to form a thermally stable in situ formation fines screen so as to filter fines from the produced oil.

It is another object of this invention to provide for a method to throughly treat a formation surrounding a well with high temperature steam.

It is yet another object of this invention to provide for an oscillatory steam treatment procedure between a first and second well so as to provide for a more efficient sweep of the pay zone with steam.

It is yet a still further object of this invention to circulate steam down the annulus of the well in an upper interval while producing thin oil from the well's tubing so as to provide for a "heat chest" effect in an upper interval of a formation.

It is an even still yet further object of this invention to accumulate gas/or steam produced from an upper interval of a formation so as easily separate them at the surface and subsequently re-inject steam into the formation.

It is a still yet even further object of this invention to provide for a steam injection process wherein the steam route can be reversed i.e., steam can be directed down the tubing of the well and oil produced up the annulus so as to prolong oil recovery from a viscous oil-containing reservoir.

DESCRIPTION OF THE PREFERRED EMBODIMENTS

In the practice of this invention two wells are drilled into a formation. The wells are cased and then selectively perforated over a one to two foot interval in the lower productive interval of the formation. Due to the shallow depth of the tar sand or other viscous hydrocarbon containing formation, the nature of the soft formation rock makes it more probable that horizonal fractures will be produced in the formation during hydraulic fracturing. A hydraulic fracturing technique is discussed in U.S. Pat. No. 4,067,389 which issued to Savins on Jan. 10, 1978. Another method for initiating hydraulic fracturing is disclosed by Medlin et al. in U.S. Pat. No. 4,378,849 which issued on Apr. 5, 1983. Both patents are hereby incorporated by reference herein. As is known by to those skilled in the art, to initiate hydraulic fracturing in a formation, the hydraulic pressure applied must exceed the formation pressures in order to cause a fracture to form. The fracture which forms will generally run perpendicular to the least principle stress in the formation or reservoir.

The fracturing fluid which is used to hydraulically fracture the formation comprises a viscous gel. The viscous gel can include a water-base hydroxypropyl guar (HPG), hydroxyethyl cellulose (HEC), carboxymethylhydroxyethyl cellulose (CMHEC), guar or oil-based diesel oil, and kerosene gelled with aluminum phosphate esters (e.g., Halliburtron Services MY-T Oil TM II, Dowell/Schlumberger's YF-GO TM B. J. Titan's ALLOFRAC TM, and The Western Company of North America's MAXI-0 TM gel).

The proppant concentration in the viscous gel should be in concentration of about 10 to about 18 pounds/gallons and can include a silicon carbide, silicon nitride or garnet proppant. These proppants are particularly preferred since they endure the high temperature effects of steam. A hydraulic fracturing method employing special sand control is disclosed by Stowe et al. in U.S. Pat. No. 4,549,608 which issued on Oct. 29, 1985. This patent is hereby incorporated by reference herein. Silicon carbide or silicon nitride which can be used herein should be of a size of from about 20 to about 100 U.S. Sieve. This fused refractory material should have a Mohs hardness of about 9. Both silicon carbide and silicon nitride have excellent thermal conductivity. Silicon nitride, for example, has a thermal conductivity of about 10.83 BTU/in sq. ft/hr./°F. at 400° to about 2400° F. A suitable silicon carbide material is sold under the Crystolon ® trademark and can be purchased from Norton Company, Metals Division, Newton, Mass. A suitable silicon nitride material can be also purchased from Norton Company. The size of the proppant used herein should be based on the particle size distribution of the formation fines so as to restrict formation fines movement into the propped fracture by the formation of a fines screen.

Figure 1:
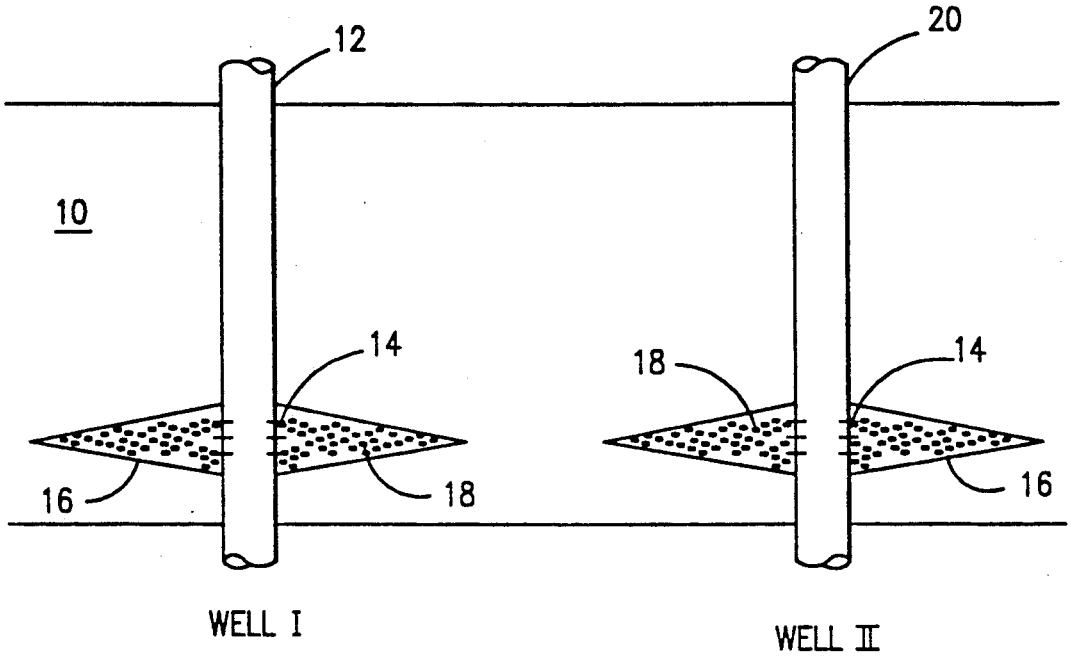
FIG. 1 is a schematic representation of a first and second well showing a fracture in the formation, which fracture has a fluid and proppant therein.
Figure 2:
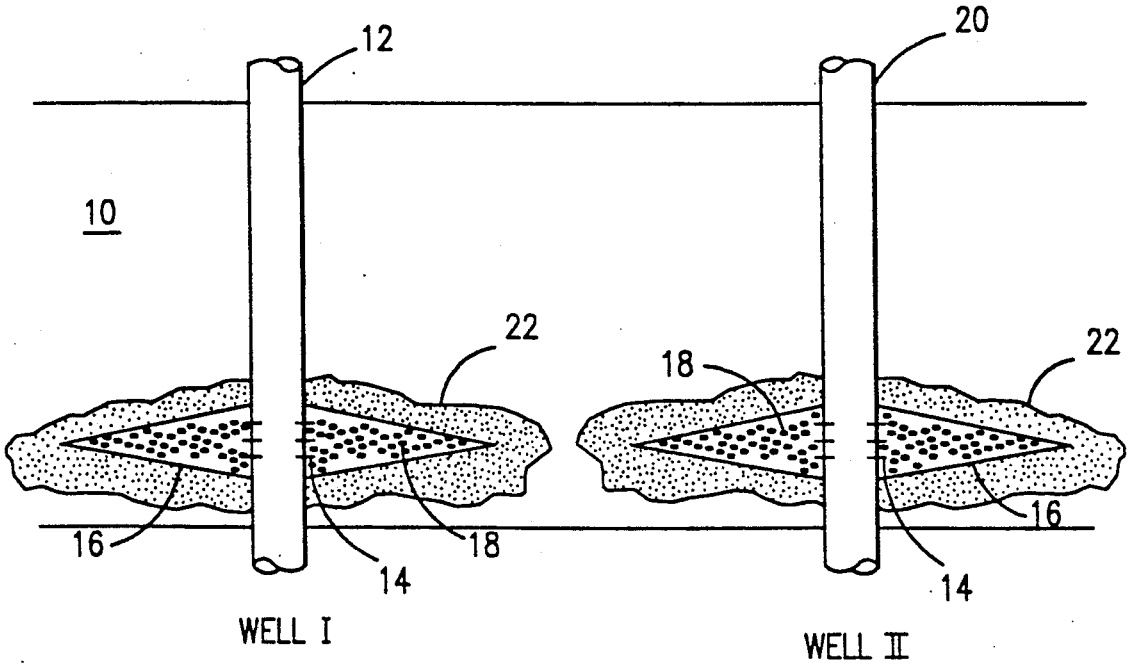
FIG. 2 is a schematic representation which shows a first and second well penetrating a formation where said formation has been fractured and the fracture propped with a fracturing fluid containing a proppant sufficient to form a fines screen at the face of the fracture.
Figure 3:
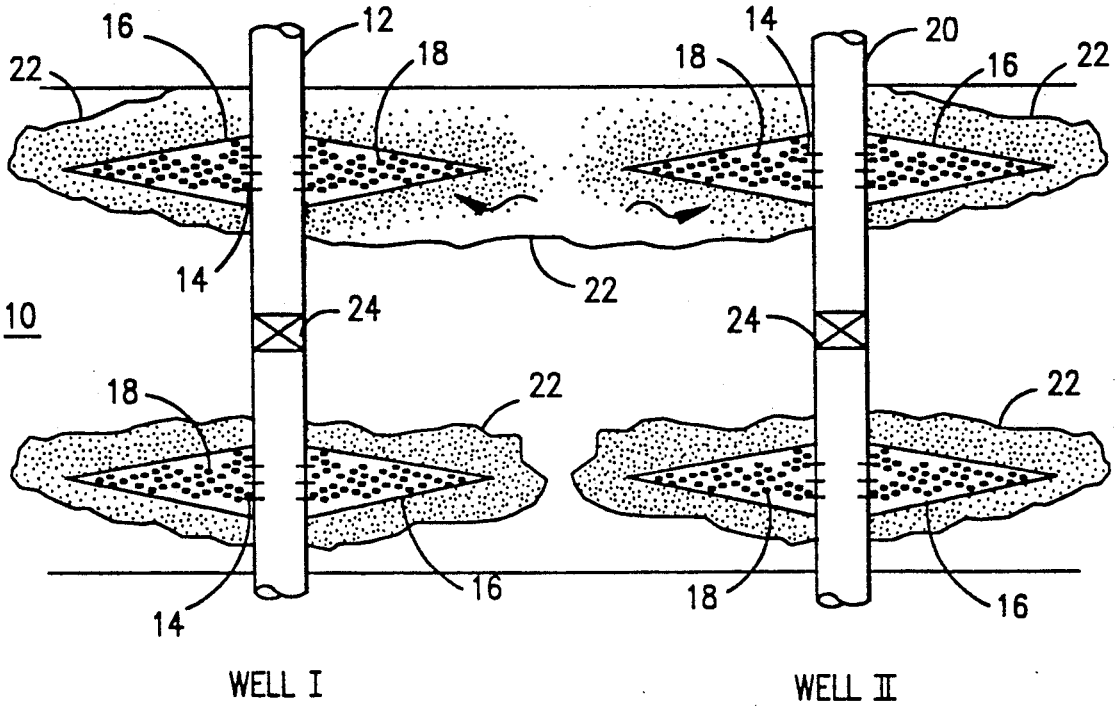
FIG. 3 is a schematic representation showing steam entering into a formation's upper interval from a first and second well.

As is shown in FIG. 1, proppant 18 has entered fractures 16 in formation 10 via perforations 14. Wells 12 and 20 are similarly fractured at a lower interval of formation 10. After fracturing both wells, a pre-determined volume of steam is injected into well 12 where it enters fracture 16 to soften tar sand or viscous hydrocarbons and to reduce the viscosity of oil adjacent to the fracture face. After injecting steam into well 12 for a desired period of time, well 12 is shut in and carefully produced to allow formation fines 22 to build up on the resulting fracture face as shown schematically in FIG. 2. As in shown in FIG. 2, fines 22 continue to build up so as to make a filter screen which filters formation fines from the produced oil. After producing well 12 for the desired amount of time, well 12 is shut-in and steam injection is commensed in well 20. Steam is injected into well 20 for a desired period of time and subsequently steam injection is ceased. Well 20 is then shut-in and afterwards oil of a reduced viscosity is carefully produced to the surface from well 20 to allow formation fines 22 to build up on the resultant fracture face as shown schematically in FIG. 2. A second volume of steam is then injected into well 20 and well 12 is then opened to production again. Well 20 is subsequently shut-in and another volume of steam is injected into well 12. Thereafter, well 20 is opened and oil of reduced viscosity which is substantially solids-free is produced to the surface. Both well 12 and well 20 are then shut-in and the lower perforated interval in both wells is isolated with production packers 24 having knock-out plugs therein as shown in FIG. 3. Once production packers 24 are in place, wells 12 and 20 are perforated at an upper productive interval of formation 10 and hydraulic fracturing is initiated in the upper productive interval as was mentioned above relative to the lower productive interval.

As mentioned previously, wells 12 and 20 are perforated over a one to two foot interval of an upper producing interval of formation 10. Both wells are hydraulically fractured as was previously done with a viscous gel containing a proppant therein so as to withstand the effects of high temperature steam injection. A proppant of similar particle size is used in the fractures which are created in upper interval of formation 10 as was used in the lower interval of said formation, so as to restrict formation fines movement into the propped fracture. Subsequently, a pre-determined volume of steam is injected into the fractures which have been created in well 12 so as to soften tar sand and reduce the viscosity of the oil adjacent to the fractured face in said upper formation. Because the upper formation interval has been isolated by production packer 24, steam can not enter into the lower interval of said formation.

Well 12 is then carefully produced so as to allow formation fines to build on the fracture face in the upper interval of formation 10 as is shown in FIG. 3. This results in an improved filter screen so as filter formation fines from the oil which is produced from the upper interval. Well 12 is then shut-in and steam injection is commenced into well 20 where steam enters into the upper productive interval since perforation packer 24 prevents steam entry into the lower interval of said formation. A volume of steam is then injected into well 12 for a desired period of time and subsequently steam injection is ceased and well 20 has a substantially solids-free oil produced to the surface. Substantially solids-free oil of reduced viscosity is obtained because it is carefully produced to the surface from well 20 to allow formation fines 22 to build up on the resultant fracture face as shown schematically in FIG. 3. Afterwards, a second volume of steam is injected into well 20 and well 12 is opened to production again. Thereafter, well 20 is shut-in and a volume of steam again injected into well 12 where it enters the upper interval of formation 10. Subsequently, well 20 is opened and a substantially solids-free oil of reduced viscosity is produced to the surface. Steam injection is continued into well 12 until steam breaks through to well 20 as is shown in FIG. 3. Wells 12 and 20 are then shut-in.

Figure 4:
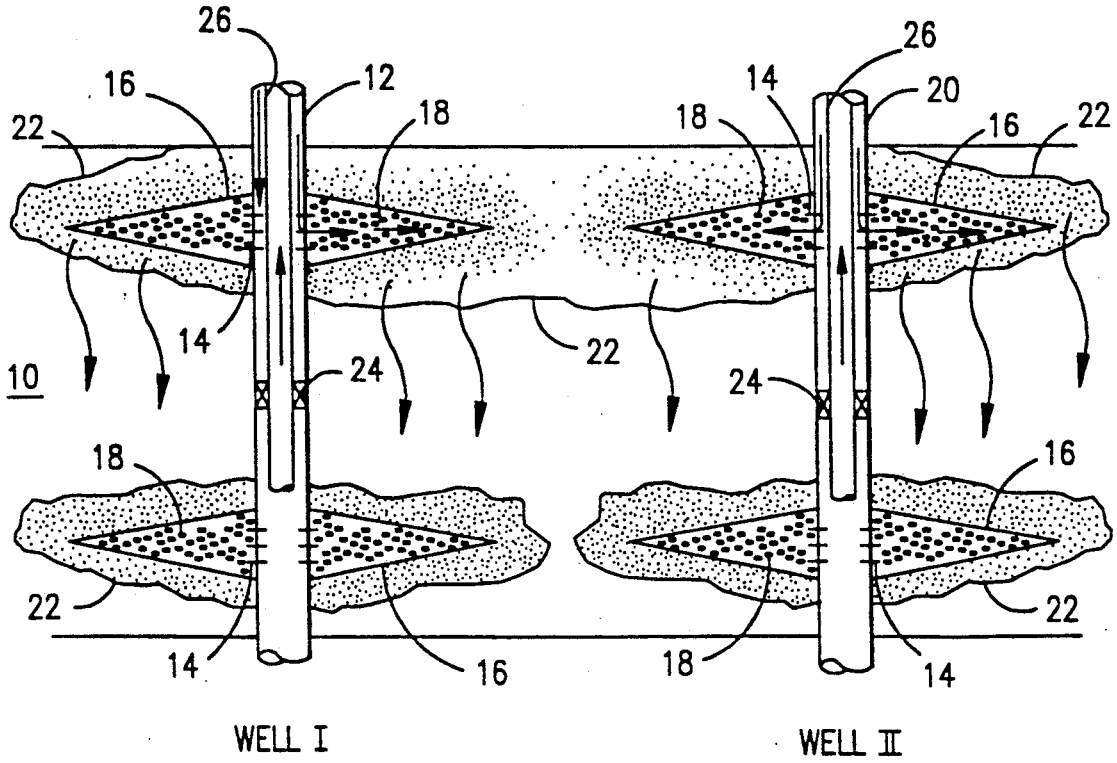
FIG. 4 is a schematic representation of a first and second well pentrating a formation and which formation contains fractures in a lower and upper interval where steam is directed through annuli of said wells into an upper interval so as to provide a "heat chest" effect in the upper interval.

Wells 12 and 20 are re-entered and production string 26 is directed through production packer 24 in each well so as to be in fluid communication with the lower productive interval of formation 10. As is shown in FIG. 4, steam is circulated down wells 12 and 20 via the annulus formed with production string 26 so as to cause the steam to enter into the upper productive interval of formation 10 through perforations 14. While circulating steam down the annuli of wells 12 and 20 thinned hydrocarbonaceous fluids are produced from the lower interval through production string 26. Circulating steam down the annuli of the wells while producing thinned hydrocarbonaceous fluids up the production string causes a "heat chest" effect in the upper part of the reservoir. This "heat chest" effect generates heat into the formation's lower interval. This heat thins the oil in the lower interval in addition to keeping the produced oil thin while being produced up production string 26 to the surface.

To prolong oil recovery, this process could be reversed. When reversed, steam is directed down production string 26 where it enters the lower interval via perforations 14. Hydrocarbonaceous fluids are then produced to the surface via perforations 14 and the annuli formed by production string 26. Because of the filter screen formed in the fracture face and the smaller gravel used in the gravel pack, substantially solids-free hydrocarbonaceous fluids are produced to the surface. The oscillatory treating method provides for a more efficient sweep of productive intervals with steam. Hydrocarbonaceous fluids and steam produced to the surface could be easily separated and re-injected into the formation for the recovery of additional hydrocarbonaceous fluids. Utilization of this method provides for prolonged recovery of substantially solids-free oil of reduced viscosity from a reservoir or formation.

Although the present invention has been described with preferred embodiments, it is to be understood that modifications and variations may be resorted to without departing from the spirit and scope of this invention, and those skilled in the art will readily understand. Such modifications and variations are considered to be within the purview and scope of the appended claims.

What is claimed is:

1. A method for producing viscous substantially solids-free hydrocarbonaceous fluids from an unconsolidated or loosely consolidated formation or reservoir comprising:

(a) drilling into said reservoir first and second spaced apart wells into a lower productive interval of said formation;

(b) perforating both wells in the lower productive interval;

(c) fracturing hydraulically said wells at said productive interval with a viscous fracturing fluid containing a proppant therein so as to prop a created fracture and form a fines screen;

(d) injecting a pre-determined volume of steam into said first well in an amount sufficient to soften said viscous fluid and lower the viscosity of said fluid adjacent a fracture face;

(e) producing the first well at a rate sufficient to allow formation fines to build up on a fracture face communicating with said first well thereby resulting in a filter screen sufficient to substantially remove formation fines from the hydrocarbonaceous fluids;

(f) shutting in said first well while injecting steam in a predetermined amount in said second well;

(g) shutting in the second well and thereafter producing hydrocarbonaceous fluids from said second well at a rate sufficient to allow formation fines to build up on a fracture face communicating with said second well which results in a filter screen sufficient to remove formation fines from produced hydrocarbonaceous fluids;

(h) injecting a second volume of steam into the second well and producing a substantially solids-free hydrocarbonaceous fluid from the first well;

(i) shutting in the second well and injecting another volume of steam into the first well;

(j) opening the second well and producing to the surface substantially solids-free hydrocarbonaceous fluids of reduced viscosity;

(k) shutting in both wells and isolating the lower perforated interval by placing production packers with knock-out plugs therein in both wells;

(l) perforating both wells at an upper productive interval of said formation so as to enable fluid communication between the first and second wells;

(m) repeating steps (c) through (k) at the upper interval of said formation;

(n) thereafter continuing steam injection into the first well until steam breaks through into the second well at the upper interval;

(o) shutting in both wells and running in production strings through said packers so as to establish fluid communication between said wells at both intervals; and (p) circulating steam down both wells into the upper interval via said perforations and an annulus formed by said production string with each well thereby forming a "heat chest" which generates heat into the lower interval while producing hydrocarbonaceous fluids from said lower interval via said production string.

2. The method as recited in claim 1 wherein the wells are cased and selectedly perforated at a one to two foot interval so as to communicate fluidly with a productive interval of the formation.

3. The method as recited in claim 1 where the unconsolidated formation comprises tar sand.

4. The method as recited in claim 1 wherein in step (c) the proppant size is determined by the particle size distribution of formation fines so as to restrict fines movement into a propped fracture.

* * * * *